US009702317B2

(12) United States Patent
Weinenger

(10) Patent No.: US 9,702,317 B2
(45) Date of Patent: Jul. 11, 2017

(54) DOUBLE WELDED STEEL PISTON WITH FULL SKIRT

(71) Applicant: Federal-Mogul Corporation, Southfield, MI (US)

(72) Inventor: Michael Weinenger, Southfield, MI (US)

(73) Assignee: Federal-Mogul LLC

( * ) Notice: Subject to any disclaimer, the term of this patent is extended or adjusted under 35 U.S.C. 154(b) by 0 days.

(21) Appl. No.: 14/471,069

(22) Filed: Aug. 28, 2014

(65) Prior Publication Data

US 2015/0059682 A1 Mar. 5, 2015

Related U.S. Application Data

(60) Provisional application No. 61/871,635, filed on Aug. 29, 2013.

(51) Int. Cl.

| | |
|---|---|
| ***F02F 3/16*** | (2006.01) |
| ***F02F 3/00*** | (2006.01) |
| *F02F 3/22* | (2006.01) |

(52) U.S. Cl.

CPC ..... *F02F 3/16* (2013.01); *F02F 3/003* (2013.01); *F02F 3/0092* (2013.01); *F02F 3/22* (2013.01); *F02F 2003/0061* (2013.01); *Y10T 29/49249* (2015.01)

(58) Field of Classification Search

CPC ..... F02F 3/16; F02F 3/20; F02F 3/22; F02F 3/0092; F02F 3/0015; F02F 3/003; F02F 5/00; F02F 2003/0061; F02F 2003/0038; F16J 1/005; F16J 1/04; B23P 15/10; B21K 1/18; B21K 1/185

USPC ..... 123/193.6, 193.1, 197.2, 41.35; 29/888.04, 888.042, 888.043; 92/186, 92/208, 255, 256, 260

See application file for complete search history.

(56) References Cited

U.S. PATENT DOCUMENTS

| | | | |
|---|---|---|---|
| 1,540,478 | A | 6/1925 | Keenan |
| 1,609,449 | A | 12/1926 | Williams |
| 1,654,595 | A | 1/1928 | McCune |

(Continued)

FOREIGN PATENT DOCUMENTS

| | | | |
|---|---|---|---|
| DE | 1253514 | B | 11/1967 |
| DE | 1949581 | A1 | 4/1971 |

(Continued)

OTHER PUBLICATIONS

International Search Report, mailed Nov. 11, 2014 (PCT/US2014/053063).

*Primary Examiner* — Grant Moubry
(74) *Attorney, Agent, or Firm* — Robert L. Stearns; Dickinson Wright, PLLC

(57) ABSTRACT

A three section steel piston for two-stroke engines is provided. The piston is provided with an upper section, a middle section and a lower section. Piston ring grooves are formed into the upper and lower sections, and pin bosses with openings and skirts are formed into the middle section. The middle section has relatively thinner walls as compared to the portions of the upper and lower sections at the piston ring grooves to reduce the mass of the piston. A closed cooling gallery may be formed adjacent an upper combustion surface of the piston with the cooling gallery being defined at least partially by the upper section.

13 Claims, 2 Drawing Sheets

(56) References Cited

U.S. PATENT DOCUMENTS

| | | | | | |
|---|---|---|---|---|---|
| 1,686,357 | A | | 10/1928 | Williams | |
| 2,244,008 | A | * | 6/1941 | Hazen et al. | 92/176 |
| 2,687,931 | A | | 8/1954 | Flynn, Jr. | |
| 2,819,936 | A | * | 1/1958 | Cambeis | 92/31 |
| 2,850,340 | A | | 9/1958 | Brill | |
| 4,011,797 | A | * | 3/1977 | Cornet | F02F 3/003 123/193.6 |
| 4,253,430 | A | | 3/1981 | Garter et al. | |
| 4,270,494 | A | | 6/1981 | Garter et al. | |
| 4,858,566 | A | * | 8/1989 | Paul et al. | 123/41.35 |
| 6,467,397 | B1 | | 10/2002 | Fuchs et al. | |
| 8,286,852 | B2 | * | 10/2012 | Kolbe | B23K 20/129 228/112.1 |
| 2008/0245231 | A1 | * | 10/2008 | Gniesmer | B23P 15/10 92/255 |
| 2011/0132971 | A1 | * | 6/2011 | Kolbe | B23K 20/129 228/114 |
| 2012/0279390 | A1 | * | 11/2012 | Boczek | 92/186 |
| 2013/0092024 | A1 | * | 4/2013 | Keller | B21K 1/18 92/255 |

FOREIGN PATENT DOCUMENTS

| | | | | | |
|---|---|---|---|---|---|
| DE | 2537182 | A1 | | 3/1977 | |
| DE | 3110292 | A1 | | 9/1982 | |
| GB | 659954 | A | | 10/1951 | |
| GB | 1352453 | A | | 5/1974 | |
| WO | WO 9913209 | A1 | * | 3/1999 | F02F 3/0069 |

* cited by examiner

DOUBLE WELDED STEEL PISTON WITH FULL SKIRT

CROSS-SECTION TO RELATED APPLICATION

This application claims the benefit of U.S. application Ser. No. 61/871,635 filed on Aug. 29, 2013.

BACKGROUND OF THE INVENTION

1. Field of the Invention

The present invention is related generally to pistons for internal combustion engines, and more particularly to pistons for two-stroke engines.

2. Related Art

A two-stroke or two-cycle engine is a type of internal combustion engine which completes a power cycle in only one crankshaft revolution. Typically, two-stroke engines have a relatively higher power-to-weight ratio, are more compact and are lighter than four-stroke engines. Two-stroke engines also typically have fewer moving parts than four stroke engines. Although two-stroke engines are commonly known for their use in small engine applications, such as outboard motors, chain saws, motorcycles and lawn mowers, they also have significant use in heavy duty diesel engine applications, such as for ships, locomotives and trucks.

There are also various types of pistons which are used in two-stroke engines, and there are many factors which influence the design of these pistons. Some of these features include size, weight, material, strength and durability. In engines which have significantly high pressures and temperatures, cooling of the pistons during use is also a factor.

It is an object of the present invention to provide improved pistons for two-stroke engines. It is also an object to provide steel pistons which are relatively light in weight (i.e. have less mass) and which can be adequately cooled to prevent overheating.

It is another object of the present invention to provide pistons which help provide improved fuel economy for a two-stroke engine and also help reduce toxic emissions.

SUMMARY OF THE INVENTION

An improved piston for two-stroke engines is provided which has reduced weight and is configured for improved cooling to prevent overheating. These features allow for improved fuel economy and reduced toxic emissions.

One aspect of the present invention provides for a piston which is made of a steel material which provides strength and durability and which can withstand higher temperatures and pressures than non-steel pistons. Two sets of grooves for piston rings are provided adjacent the top and bottom surfaces of the pistons. The pistons are made in three sections including an upper (or crown) section, a middle section and a lower section. The lower section includes a lower set of piston ring grooves, and either the upper section or the middle section contains an upper set of piston ring grooves. The middle section is made with thinner walls than the lower section at the location of the lower set of ring grooves, thereby reducing the weight and mass of the piston. The three sections are bonded permanently together, such as by friction welding, to form an integral one-piece piston. A cooling gallery is created between the upper section and the middle section for cooling the upper section to prevent overheating.

Another aspect of the present invention provides for a method of forming a piston for a two-stroke engine. The method includes the step of providing a first crown section which has a first sidewall portion of a first sidewall thickness. The method continues with the step of providing a second center-section which has a second sidewall portion of a second sidewall thickness and has a pair of pin bosses. The method proceeds with the step of providing a third lower section which has a third sidewall portion that has a third sidewall thickness and which is adapted for the formation of at least one piston ring groove. The thickness of the second sidewall is less than the third sidewall thickness at least in the locations where at least one piston ring groove can be formed. The method proceeds with the steps of bonding the first crown section to the second center section and bonding the third lower section to the second center section.

The method may further include the steps of forming at least one piston ring groove in the first sidewall portion of the first crown section and forming at least one piston ring groove in the third sidewall portion of the third lower section.

The method may still further include the step of forming a cooling gallery between the first crown section and the second center section.

The method may additionally include the step of forming a closed cooling gallery between the first crown section and the second center section.

The method may further include the step of forming oil ingress and egress openings in the cooling gallery.

BRIEF DESCRIPTION OF THE DRAWINGS

These and other features and advantages of the present invention will be readily appreciated, as the same becomes better understood by reference to the following detailed description when considered in connection with the accompanying drawings wherein.

DESCRIPTION OF THE ENABLING EMBODIMENTS

Figure 1:
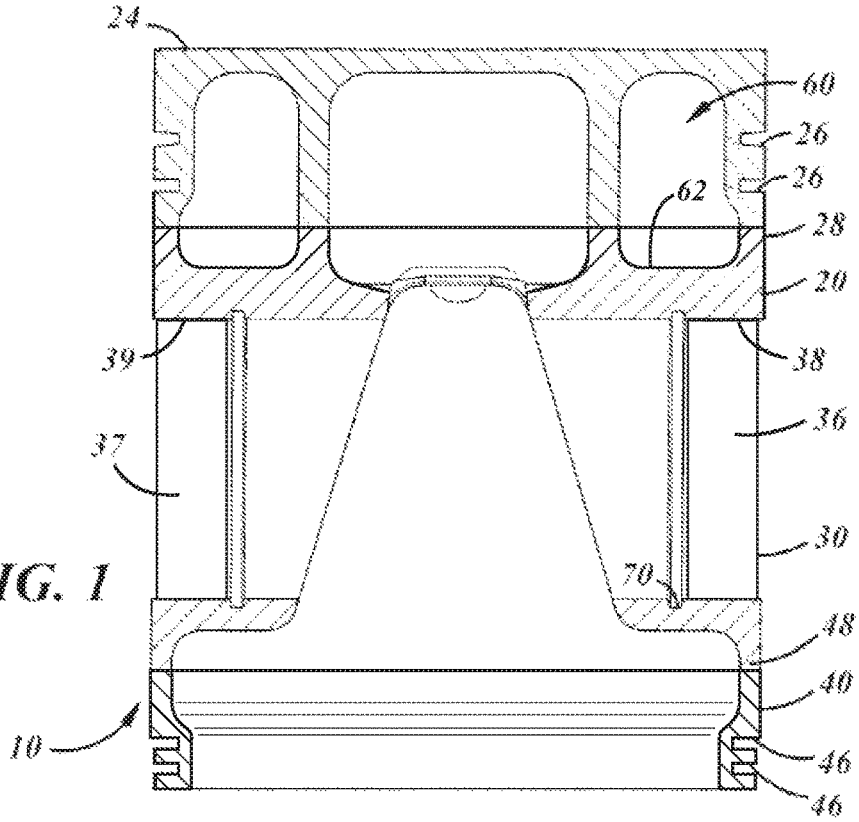
FIG. 1 is a cross-sectional view of a preferred embodiment of the invention.
Figure 2:
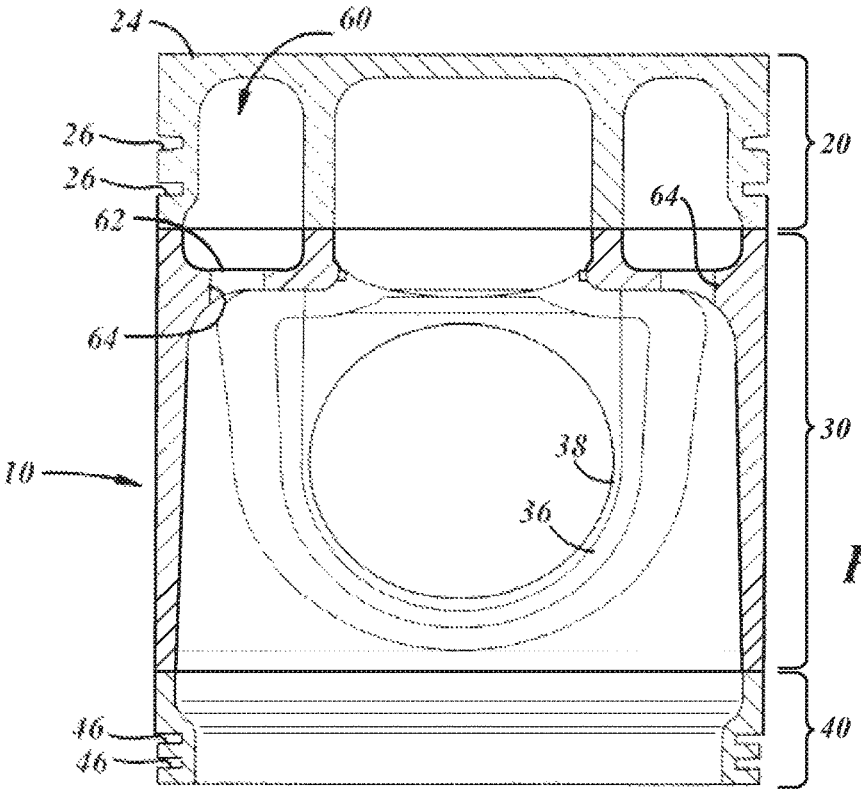
FIG. 2 is another cross-sectional view of a preferred embodiment of the invention.
Figure 4:
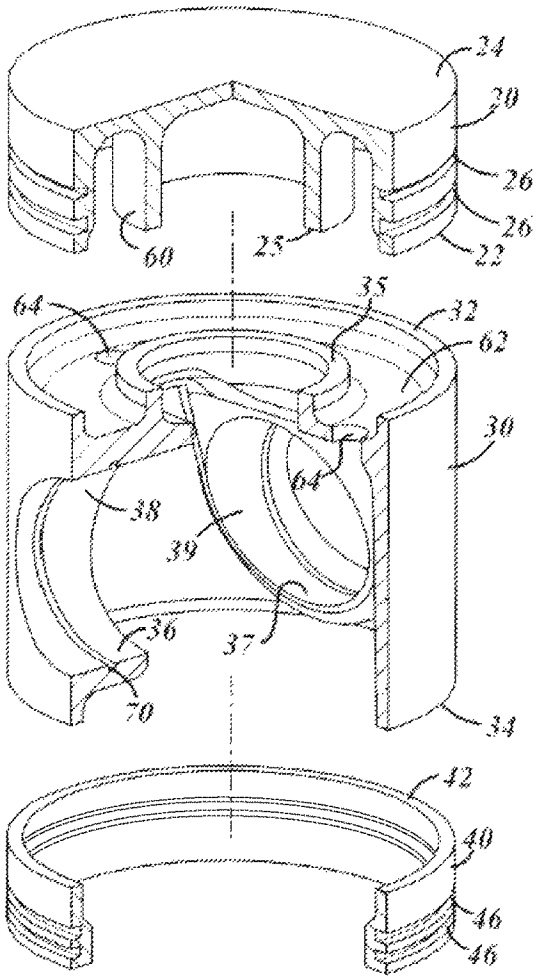
FIG. 4 is another exploded view of the three sections forming a preferred embodiment of the invention.
Figure 3:
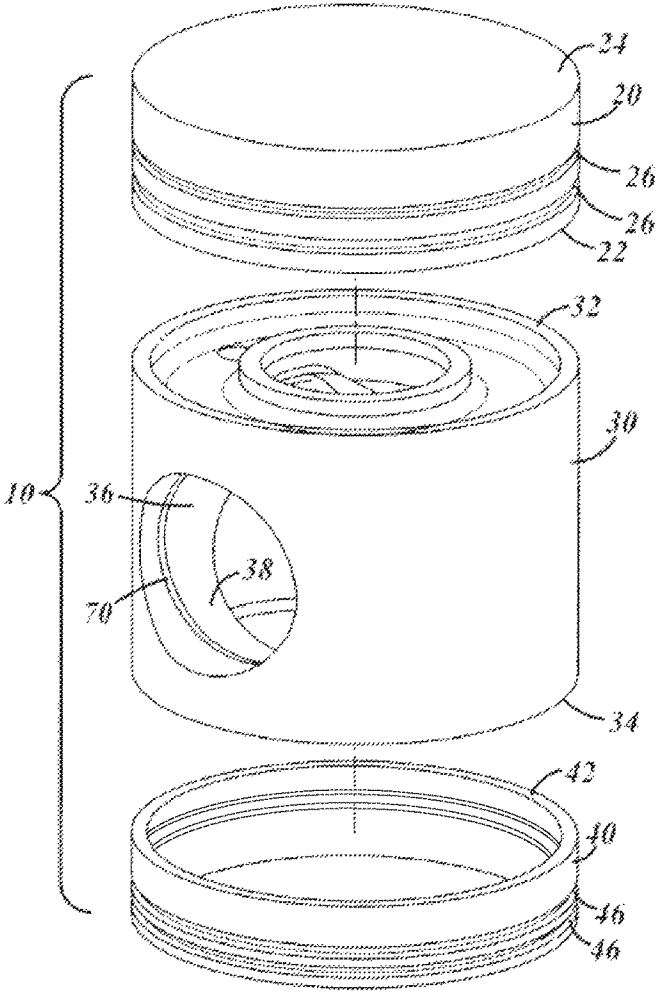
FIG. 3 is an exploded view of the three sections forming a preferred embodiment of the invention.

Referring to the Figures, wherein like numerals indicate corresponding parts throughout the several views, FIGS. 1-4 illustrate an exemplary embodiment of an improved piston 10 for use in a two-stroke power cycle internal combustion engine. FIGS. 1 and 2 show cross-sectional views of the piston 10, with the two cross-sectional views being taken at 90° angles relative to one another. FIG. 3 is an exploded view of the piston 10 showing the three sections 20, 30 and 40 which will be bonded together to form the piston 10. FIG. 4 is an exploded view similar to FIG. 3, but with portions of each of the sections removed for ease of viewing and understanding of the invention.

The three sections 20, 30, 40 are each made separately and each is made of a steel material. One preferred steel material is SAE 4140, but other types of steel could also be utilized. Each of the three sections 20, 30, 40 is preferably shaped at least to a rough form through a forging process, although other processes could be utilized. The sections 20, 30, 40 are made in a rough form and are then subjected to initial machining before being integrally attached together. Specifically, generally flat annular surfaces 22, 32, 34, 42 for mating the three sections 20, 30, 40 together are machined into the three sections 20, 30, 40 after the forging operation. Rather than being generally flat as they are in the exemplary embodiment, the annular surfaces 22, 32, 34 and 42 could alternately be sculptured or made with mating recesses, projections, grooves, ridges, and the like to allow the sections to be more easily positioned, mated and bonded together.

The three sections 20, 30, 40 are bonded together, such as by friction welding or induction welding, to form a one-piece piston structure 10, as shown in FIGS. 1 and 2. Other systems for permanently attaching the three sections together could also be utilized, such as conventional welding or brazing.

The three sections 20, 30, 40 may be bonded together at the same time, i.e., simultaneously. However, preferably the top section 20 or the bottom section 40 is first attached to the middle section 30, and then the resultant two-piece structure is attached to the remaining section. Joining the top and bottoms sections 20, 40 with the middle section 30 separately (not simultaneously) is especially preferred where friction welding is employed as the joining process. Any resulting flash or tailings may be removed, if removal is desired, by machining.

Once the three sections 20, 30, 40 are affixed together, the two sets of piston ring grooves are formed in the piston 10 with one of the sets (hereinafter referred to as the "upper ring grooves 26") being located adjacent a top end of the piston 10 and the other of the sets (hereinafter referred to as the "lower ring grooves 46") being located adjacent a bottom of the piston 10. As shown, in the exemplary embodiment, the upper ring grooves 26 are formed into the exterior annular side surface 28 of the upper section 20, the lower ring grooves are formed into the exterior side surface 48 of the lower section 40, and the middle section 30 is free of ring grooves. In the exemplary embodiment, the middle section 30 is free of ring grooves. The number of ring grooves in each of the piston sections is a design choice which may depend upon the ultimate use of the piston and the environment in which it will be positioned. Preferably, at least two piston ring grooves are provided in each of the two sets of piston ring grooves. The piston ring grooves may be formed into the piston 10 through, for example, machining.

In order to accommodate the piston ring grooves 26, 46, the side walls of the upper section 20 and the lower section 40 have increased thickness as compared to the relatively thinner walls of the middle section 30. This allows for reduced overall mass in the piston 10 as well as reduced manufacturing and material costs. As shown in FIG. 4, in the exemplary embodiment, the upper and lower sections 20, 40 also have portions with relatively thinner wall thickness in the areas where they are bonded to the middle section 30.

In the exemplary embodiment, the upper section 20, or crown, of the piston 10 has a generally planar upper combustion surface 24. Alternately, the combustion surface may be formed with a combustion bowl which may be formed during forging of the upper section 20.

The middle section 30 also has a pair of pin bosses 36, 37 which are positioned diametrically across from one another. Openings 38 and 39 are formed in the two pin bosses 36, 37. The openings 38 and 39 are axially aligned with one another along a wrist pin axis for receiving a wrist pin (not shown) for holding the piston 10 on a connecting rod (not shown). In the exemplary embodiment, snap ring grooves 70 are provided in the pin bosses 36, 37 for snap rings to assist in holding a wrist pin in place.

In the exemplary embodiment, a cooling gallery 60 is formed in the piston 10 for cooling the upper section 20 of the piston 10. The cooling gallery 60 is shown in the drawings as a closed gallery with an integral lower surface 62, but the gallery could also be an open gallery. If a closed gallery is utilized, then a plurality of openings 64 are provided in the lower surface 62 for oil to be introduced into the gallery and to be allowed to drain out. Any number of openings 64 can be provided as desired. The openings 64 may be drilled through the lower surface 62 before or after the upper and middle sections 20, 30 are bonded together, or after the three sections 20, 30, 40 are all bonded together. The cooling gallery 60 allows cooling oil (not shown) to be circulated against the upper surface and rim of the piston 10 to prevent them from overheating, which could lead to premature failure of the piston.

For strength and integrity of the completed piston structure 10, it is also possible to bond an additional surface 25 of the upper section 20 with a raised surface 35 of the middle section 30. For this purpose, the annular surfaces 25, 35 are preferably machined in the same manner as surfaces 22, 32, 34 and 42.

In another embodiment, it is also possible to leave a gap (not shown) between the annular surfaces 25 and 35 with the width of the gap being determined depending on its effect on retaining and/or draining oil from the gallery 60. Alternatively, holes could be formed in the vertical surface perpendicular to surfaces 25 and 35.

Obviously, many modifications and variations of the present invention are possible in light of the above teachings and may be practiced otherwise than as specifically described while within the scope of the appended claims.

What is claimed is:

1. A piston for a two-stroke engine comprising:

a crown piece made as a single piece of metal and presenting an upper combustion surface and a portion of a cooling gallery and a first set of ring grooves and a pair of radially spaced apart first lower mounting surfaces;

a center piece made as a single forged piece of metal, said center piece presenting a pair of pin bores which open to an outer circumference of said center piece, said center piece having another portion of said cooling gallery, said center piece presenting a pair of radially spaced first upper mounting surfaces that are bonded with said first lower mounting surfaces of said crown piece, and said center piece presenting a second lower mounting surface;

a lower piece made as a single piece of metal, said lower piece having a side wall with a thick portion and a thin portion, a second set of ring grooves being formed into said thick portion, and said thin portion presenting a second upper mounting surface and said second lower mounting surface of said second piece being bonded to said second upper mounting surface of said lower piece.

2. The piston as described in claim 1 wherein said crown piece is friction welded to said center piece, and said center piece is friction welded to said lower piece.

3. The piston as described in claim 1 wherein said crown piece is friction welded to said center piece.

4. The piston as described in claim 1 wherein said lower piece is friction welded to said center piece.

5. The piston as described in claim 1 wherein said crown piece is induction welded to said center piece, and said center piece is friction welded to said lower piece.

6. The piston as described in claim 1 wherein said crown piece is induction welded to said center piece.

7. The piston as described in claim 1 wherein said cooling gallery is closed and further comprises a plurality of openings to allow cooling oil to enter and exit from said cooling gallery.

8. A method of making a piston for a two-stroke engine, said method comprising:

preparing a crown piece which is made as a single piece of metal and presents an upper combustion surface and a portion of a cooling gallery and a pair of radially spaced apart first lower mounting surfaces;

forging a center piece of a single piece of metal, the center piece presenting a pair of pin bores which open to an outer circumference of the center piece, the center piece having another portion of the cooling gallery, the center piece presenting a pair of radially spaced apart first upper mounting surfaces, and the center piece presenting a second lower mounting surface;

preparing a lower piece made as a single piece of metal, the lower piece having a sidewall with a thick portion and a thin portion, a second set of ring grooves formed into the thick portion, and the thin portion presenting a second upper mounting surface;

bonding the first lower mounting surfaces of the crown piece to the first upper mounting surfaces of the center piece; and bonding the second upper mounting surface of the lower piece to the second lower mounting surface of the center piece.

9. The method as described in claim 8 further comprising the step of forming oil ingress and egress openings in the cooling gallery.

10. The method as set forth in claim 8 wherein the step of bonding the first lower mounting surfaces of the crown piece to the first upper mounting surfaces of the center piece is further defined as friction welding the first lower mounting surfaces of the crown piece to the first upper mounting surfaces of the center piece.

11. The method as set forth in claim 8 wherein the step of bonding the second upper mounting surface of the lower piece to the second lower mounting surface of the center piece is further defined as friction welding the second upper mounting surface of the lower piece to the second lower mounting surface of the center piece.

12. The method as set forth in claim 8 wherein the step of bonding the first lower mounting surfaces of the crown piece to the first upper mounting surfaces of the center piece is further defined as induction welding the first lower mounting surfaces of the crown piece to the first upper mounting surfaces of the center piece.

13. The method as set forth in claim 8 wherein the step of bonding the second upper mounting surface of the lower piece to the second lower mounting surface of the center piece is further defined as induction welding the second upper mounting surface of the lower piece to the second lower mounting surface of the center piece.

* * * * *